United States Patent [19]

Squire et al.

[11] Patent Number: 5,063,765

[45] Date of Patent: Nov. 12, 1991

[54] LOCK PROTECTOR

[76] Inventors: Ross D. Squire, 75 Liverpool Road, Burwood Heights, Australia, N.S.W. 2136; Ian H. Squire, 337 Fifteenth Avenue, Hoxton Park, Australia, N.S.W. 2171

[21] Appl. No.: 327,968

[22] PCT Filed: Aug. 17, 1987

[86] PCT No.: PCT/AU87/00271

§ 371 Date: Mar. 21, 1989

§ 102(e) Date: Mar. 21, 1989

[87] PCT Pub. No.: WO88/01333

PCT Pub. Date: Feb. 25, 1988

[30] Foreign Application Priority Data

Aug. 15, 1986 [AU] Australia ..... PH7527

[51] Int. Cl.[5] ..... E05B 15/16

[52] U.S. Cl. ..... 70/417; 70/423; 70/448

[58] Field of Search ..... 70/416–418, 70/423, 424, 427, 453–455, 448

[56] References Cited

U.S. PATENT DOCUMENTS

| | | | |
|---|---|---|---|
| 962,276 | 6/1910 | Voight | 70/423 X |
| 1,484,831 | 2/1924 | Hurd | 70/417 |
| 2,049,658 | 8/1936 | Moore | 70/448 X |
| 2,225,703 | 12/1940 | Machinist | 70/417 |
| 3,821,886 | 7/1974 | Ladewig | 70/454 X |
| 4,074,552 | 2/1978 | Smith | 770/417 |
| 4,094,177 | 6/1978 | Wellekens | 70/423 |
| 4,160,368 | 7/1979 | Solow | 70/417 |
| 4,167,222 | 9/1979 | El Bindari | 70/417 X |
| 4,362,035 | 12/1982 | Vitale | 70/416 X |
| 4,446,709 | 5/1984 | Steinbach | 70/424 X |
| 4,490,998 | 1/1985 | Wellekens | 70/427 X |
| 4,662,198 | 5/1987 | Scherbing | 70/448 X |

FOREIGN PATENT DOCUMENTS

| | | | |
|---|---|---|---|
| 2141478 | 12/1984 | United Kingdom | 70/423 |

*Primary Examiner*—Robert L. Wolfe
*Assistant Examiner*—Suzanne L. Dino
*Attorney, Agent, or Firm*—Merchant & Gould, Smith, Edell, Welter & Schmidt

[57] ABSTRACT

A lock protector (1) for the barrel (17) of a key operated lock (2) which comprises a sleeve (3) to fit over the barrel (17). The sleeve (3) has a rotatable keyway protector (7) located adjacent the keyway (6) of the lock (2), the keyway protector (7) having a slot (10) therein which aligns itself with the keyway (6) for use. The width of the slot (10) together with the distance between the external portion of the slot (10) and the keyway (6) prevents objects other than the correct key shank from being inserted within. The lock protector (1) is also provided with a retaining means (4) to prevent longitudinal movement of the barrel (17) within the sleeve (3) once assembled.

9 Claims, 4 Drawing Sheets

LOCK PROTECTOR

TECHNICAL FIELD

The present invention relates to locks and, more particularly but not exclusively, to a lock protector for a key operated lock. Although not restricted thereto, the present invention finds particular application in connection with motor vehicle ignition switch locks.

BACKGROUND

In the past, unauthorised persons have gained access to ignition switch locks in several ways. One such method entails the jamming of a key blank into the keyway of the lock and applying a force sufficient to rupture and turn the locking mechanism within the barrel, thereby operating the lock. Another well practised method of gaining illegal entry is to insert a self tapping screw into the keyway and then with the use of a screwdriver, apply enough force to rupture the locking mechanism and operate the lock. In general, a major disadvantage of present day locks, is the fact that objects other than the operating key may be inserted into the keyway and used to forcibly operate the lock.

It is therefore an object of the present invention to overcome or substantially ameliorate the abovementioned disadvantages.

SUMMARY OF THE INVENTION

In accordance with one broad form the present invention provides a lock protector adapted to protect the barrel of a key operated lock, said protector comprising a sleeve shaped to fit over said barrel, retaining means to secure said sleeve to said barrel against relative longitudinal movement therebetween, one end of said barrel having a keyway therein for operation of said lock, and the corresponding end of said sleeve having a keyway protector rotatably mounted therein and overlying said keyway, said protector having a narrow slot therethrough, the width of said slot and the distance between the outermost portion of said slot and said keyway being selected to permit the shank of the operating key to pass through the slot and into the keyway but prevent the insertion of objects other than the key into said keyway.

In a preferred embodiment, the retaining means comprises a non-return screw or break-off bolt. Preferably, the rotatable keyway protector would be mounted within the sleeve by way of a circlip arrangement, by means of chamfered edges or by a step or rebate configuration.

BRIEF DESCRIPTION OF THE DRAWINGS

Some preferred embodiments of the present invention will now be described, by way of example only, with reference to the accompanying drawings in which.

DETAILED DESCRIPTION OF THE DRAWINGS

Figure 1:
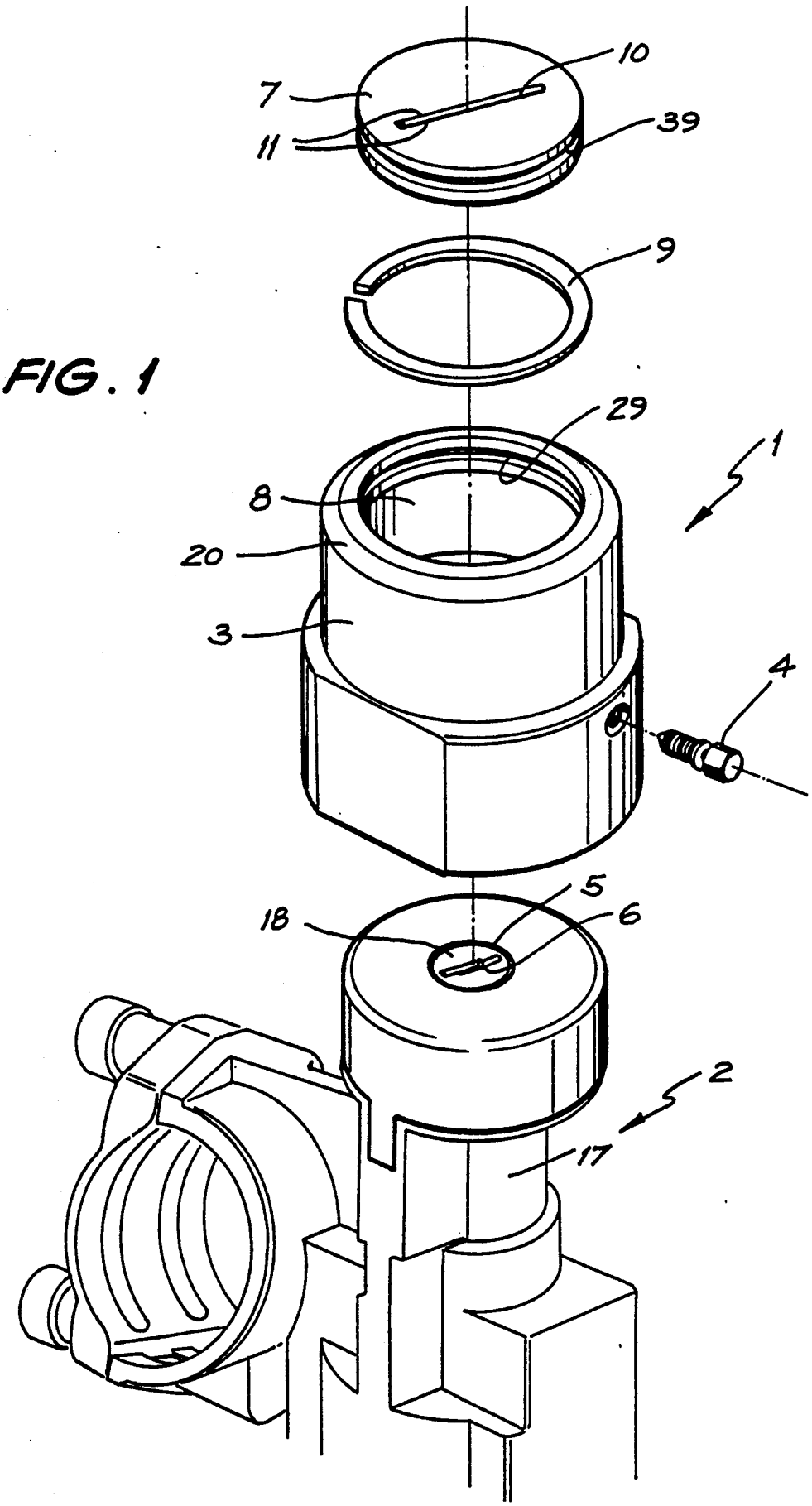
FIG. 1 is an exploded perspective view of one embodiment of an assembled lock protector together with the lock.
Figure 2:
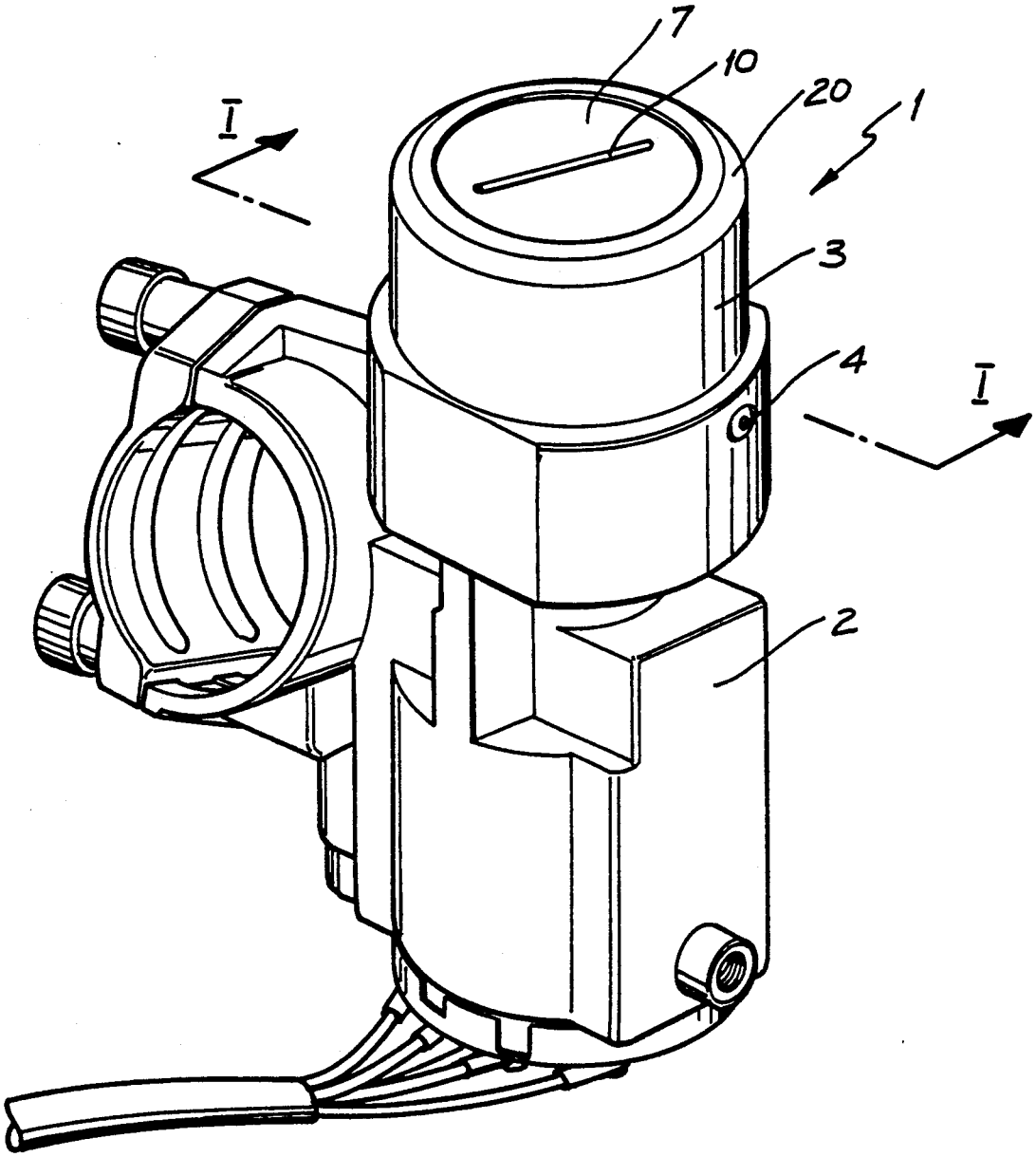
FIG. 2 is the perspective view of the assembled lock and protector of FIG. 1.
Figure 3:
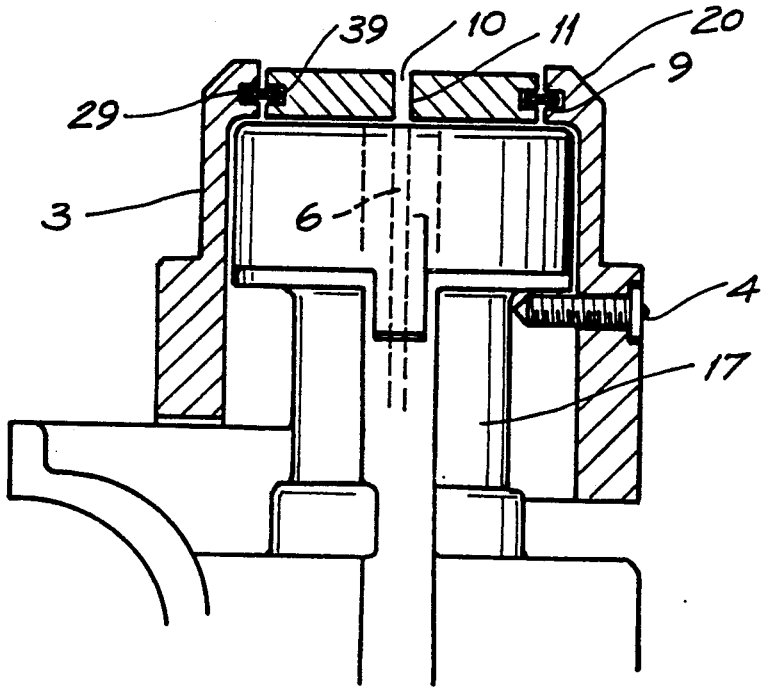
FIG. 3 is a sectioned view of the assembly of FIG. 2 along line I—I.

In FIG. 1 there is schematically depicted a lock protector 1 together with a lock 2. The lock protector 1 comprises a sleeve 3 into which the lock 2 is able to be placed. As best seen in FIG. 3, lock 2 is held within the sleeve 3 by way of a non-return or break-off screw 4. If the lock 2 should be rotated within said sleeve 3, the screw 4 cuts a groove (not shown) into the outer circumference of the lock barrel or outer casing 17. This is mainly due to the relatively soft metal from which the lock barrel 17 is cast. Since the screw 4 will sit within the circumferential groove it cuts, the sleeve 3 is prevented from being withdrawn from the lock barrel 17 once secured in position.

A keyway 6 is located in the outer facing end 5 of the cylinder 18 of the lock 2. Overlying the keyway 6, and within the sleeve 3, is a keyway protector 7. In this embodiment, the keyway protector 7 is in the form of a disc mounted by way of a circlip 9, within the aperture 8 of the sleeve 3. As best seen in FIG. 3 the circlip 9 expands to partially occupy an annular groove 29 in the aperture 8 as well as a similar groove 39 in the disc 7. In this way the keyway protector 7 cannot be withdrawn from the sleeve 3 after assembly.

The keyway protector 7 has a narrow slot 10, which when properly aligned with the keyway 6, allows the shank of the operating key (not shown) to pass therethrough and into the keyway 6.

The width of the slot 10, together with the distance between the outermost edges 11 of the slot 10 and the keyway 6, are selected so that only the shank of the operating key can pass therethrough, effectively preventing insertion of other objects, such as a screwdriver or self tapping screw, into the keyway 6.

Figure 4:
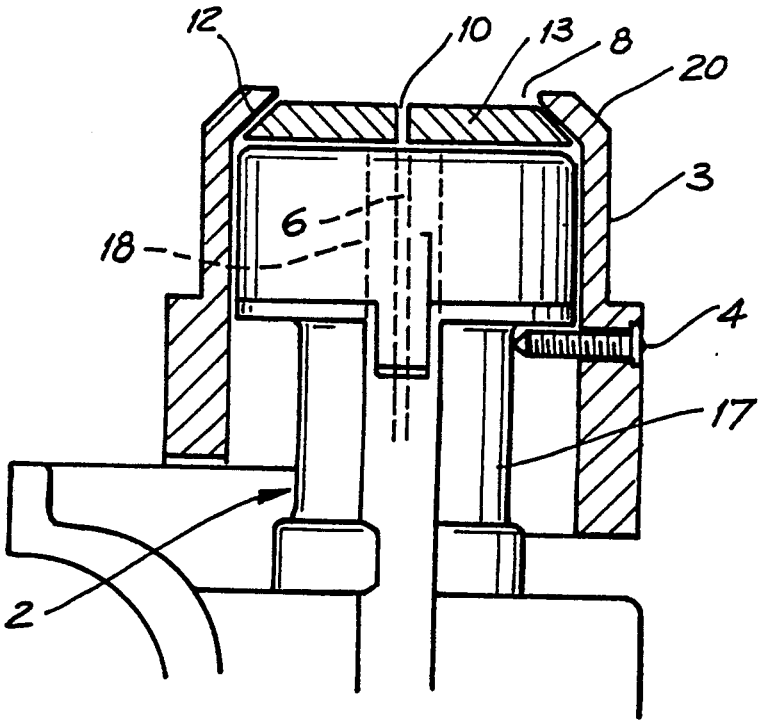
FIGS. 4. 5 and 6 show in cross section further embodiments of the lock protector of the present invention together with the lock.

A further embodiment is shown in FIG. 4 in which the inner walls 12 of the aperture 8 are chamfered so as to accommodate a frusto-conical shaped keyway protector 13. Again the protector 13 is rotatable within the sleeve 3 but is unable to be removed after assembly.

Figure 5:
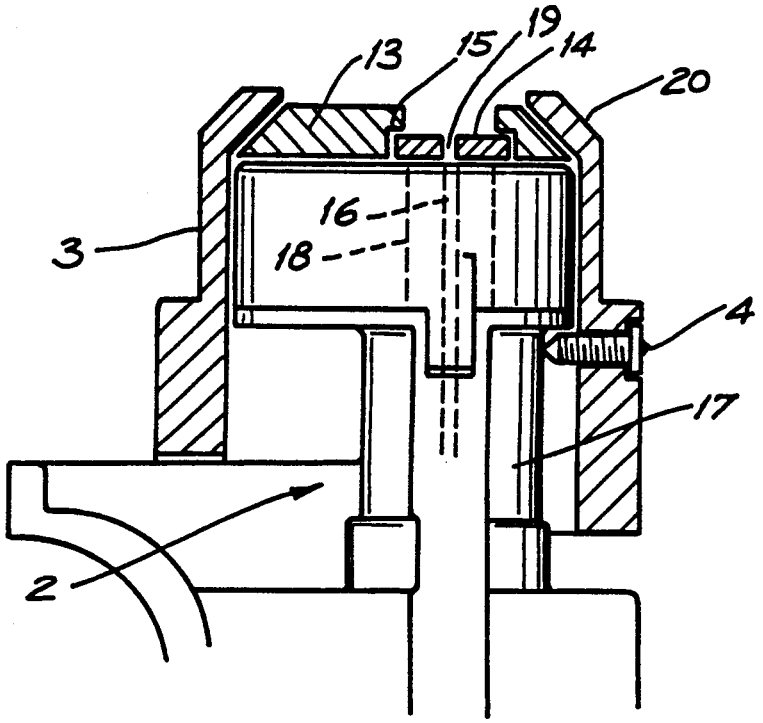

Yet another embodiment is shown in FIG. 5, wherein there is depicted a lock 2 with an offset keyway 16 and cylinder 18. In this embodiment, there is also provided a disc 14 positioned between the keyway protector 13 and the barrel 17. This disc 14 fits within a recess 15 of the keyway protector 13, thereby allowing rotation of the disc 14. The disc 14 is also provided with a slot 19 which is able to be aligned with the keyway 6 when the operating key is inserted.

Figure 6:
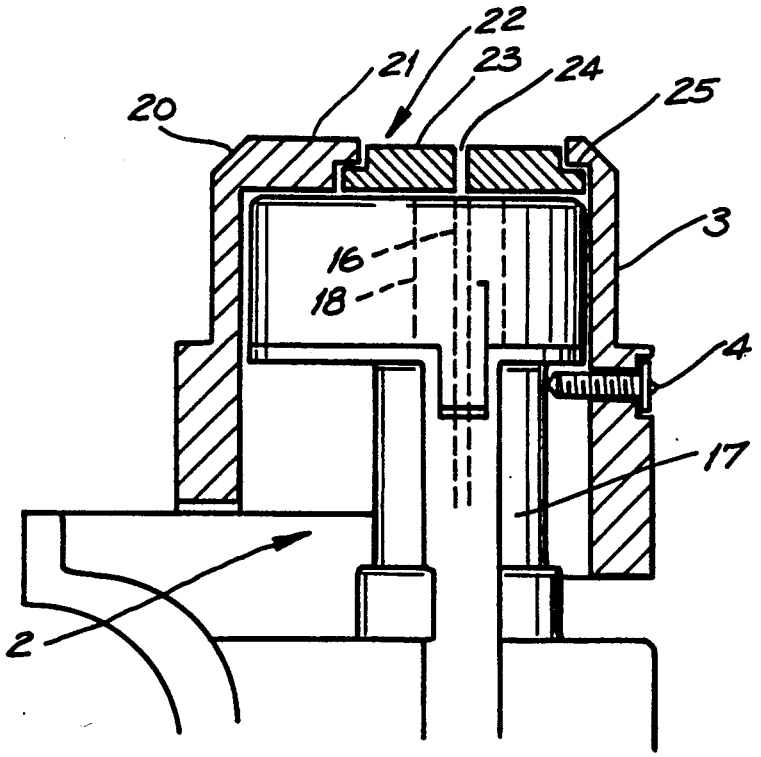

The embodiment of FIG. 6 shows the sleeve 3 having a partially enclosed end 21 with an aperture 22 therein to house the keyway protector 23. The keyway protector 23 has a slot 24 as above, however, the keyway protector 23 is held within the aperture 22 by a step or rebate 25. This is similar to the disc 14 arrangement of FIG. 5.

It will be apparent to those skilled in the art that the above described arrangements provide a number of advantages. Firstly any attempt to insert a screw driver tip, or self tapping screw into the slots 10, 19 will only result in rotation of the discs 7. 14 - not rotation of the lock cylinder 18. Secondly, the outer edges of the sleeve 3 are bevelled as indicated at 20 thereby detering any attempt to grasp the sleeve with multigrips, pliers or the like. As explained above should the sleeve 3 be rotated relative to the lock barrel 18, longitudinal movement of the sleeve 3 relative to the barrel 18 is prevented by the groove cut by the screw 4. Furthermore, many car owners have quite large and heavy key rings and many keys on them, and as a result, unnecessary wear on the conventional lock occurs, the body of which is a low quality die cast.

The foregoing describes only some embodiments of the present invention and modifications, obvious to those skilled in the art, can be made thereto without departing from the scope of the present invention. For example, the keyway protector need not be in close proximity with the lock, provided the distance between the outermost edge of the slot of the keyway protector to the keyway itself is sufficient to prevent the insertion of foreign objects within the keyway.

We claim:

1. A lock protector adapted to protect the barrel of a key operated lock, said protector comprising a sleeve shaped to fit over said barrel, retaining means comprising a threaded radially-directed fastener arranged to engage said barrel to secure said sleeve directly to said barrel against relative longitudinal movement therebetween, one end of said barrel having a keyway therein for operation of said lock, and the corresponding end of said sleeve having a flat disc-like keyway protector rotatably mounted therein and overlying said keyway, said protector having a narrow slot therethrough the width of said slot and the distance between the outermost portion of said slot and said keyway being selected to permit the shank of the operating key to pass through the slot and into the keyway but prevent the insertion of objects other than the key into said keyway.

2. A lock protector according to claim 1 wherein the retaining means comprises a fastener selected from the class consisting of non-return screws and break-off bolts.

3. A lock protector according to claim 1 wherein the rotatable keyway protector comprises a disc mounted within the sleeve by means of a circlip retained on the keyway protector in a circumferential groove and slidable within an annular groove in the interior of said sleeve.

4. A lock protector according to claim 1 wherein the rotatable keyway protector is a substantially frustoconical disc and is retained within the sleeve by means of a chamfered edge at said corresponding sleeve end, the smallest diameter of said chamfered edge being less than the largest diameter of said keyway protector.

5. A lock protector according to claim 1 wherein the rotatable keyway protector is mounted within the sleeve by interengagement of a pair of complementary stepped shoulders, one on said sleeve and one on said keyway protector.

6. A lock protector according to any claim 1 wherein the keyway and associated slot within the keyway protector are off centre relative to the longitudinal axis of said sleeve.

7. A lock protector according to claim 1 wherein said keyway protector comprises a first disc rotatary positioned within and substantially co-planar with a second disc.

8. A lock protector according to claim 7 wherein both discs are rotatably mounted and have a maximum diameter larger than the minimum diameter of the surrounding member.

9. A lock protector adapted to protect the barrel of a key operated lock, said protector consisting of a sleeve shaped to fit over said barrel, retaining means comprising a threaded radially-directed fastener arranged to engage said barrel to secure said sleeve directly to said barrel against relative longitudinal movement therebetween, one end of said barrel having a keyway therein for operation of said lock, and the corresponding end of said sleeve having a flat disc-like keyway protector rotatably mounted therein and overlying said keyway, said protector having a narrow slot therethrough the width of said slot and the distance between the outermost portion of said slot and said keyway being selected to permit the shank of the operating key to pass through the slot and into the keyway but prevent the insertion of objects other than the key into said keyway.

* * * * *